United States Patent [19]

Carrell

[11] Patent Number: 4,712,784

[45] Date of Patent: Dec. 15, 1987

[54] ADJUSTABLE VACUUM PAD

[75] Inventor: Ross M. Carrell, Cinnaminson, N.J.

[73] Assignee: RCA Corporation, Princeton, N.J.

[21] Appl. No.: 739,918

[22] Filed: May 31, 1985

[51] Int. Cl.[4] ..... B65H 3/08

[52] U.S. Cl. ..... 271/108; 294/64.1; 901/40

[58] Field of Search ..... 294/64.1, 64.3, 64.2; 271/90, 96, 98, 108; 901/40

[56] References Cited

U.S. PATENT DOCUMENTS

| | | | |
|---|---|---|---|
| 1,575,892 | 3/1926 | Ashby . | |
| 2,852,253 | 9/1958 | Pouliart | 226/95 |
| 2,984,398 | 5/1961 | Chalmers | 226/95 |
| 3,137,390 | 6/1964 | Atanasoff et al. | 209/72 |
| 3,334,896 | 8/1967 | Mullin | 271/108 |
| 3,421,753 | 1/1969 | Staples, Jr. | 271/26 |
| 3,504,910 | 4/1970 | Spyropoulos | 271/98 |
| 3,617,048 | 11/1971 | Albert | 271/26 |
| 3,815,762 | 6/1974 | Hoke et al. | 215/8.5 A |
| 4,216,955 | 8/1980 | Avritt | 271/197 X |
| 4,327,906 | 5/1982 | Fröhlich | 271/103 |

FOREIGN PATENT DOCUMENTS

| | | | |
|---|---|---|---|
| 75770 | 6/1977 | Japan | 901/40 |

OTHER PUBLICATIONS

IBM Technical Disclosure Bulletin, vol. 24, No. 5, pp. 2526, 2527, Oct. 1981, "Pressure/Vacuum Sensing Device", K. H. Westermann.

*Primary Examiner*—Richard A. Schacher

*Attorney, Agent, or Firm*—Joseph S. Tripoli; William Squire

[57] ABSTRACT

A vacuum pad has a plurality of orifices on one surface. Structure is provided for creating, at selected ones of said orifices, a reduced pressure relative to atmospheric pressure and for creating at the other orifices an elevated pressure relative to the atmospheric pressure.

7 Claims, 5 Drawing Figures

ADJUSTABLE VACUUM PAD

BACKGROUND OF INVENTION

1. Field of Invention

This invention relates to article moving means and more particularly to such means incorporating vacuum to aid in article movement.

2. Description of the Prior Art

In the movement of sheet materials it is known to utilize vacuum pads or vacuum cups on the end of articulated arms to lift a particular item from a stack of similar items for purposes of singulating the items. Such apparatus is commonly found in printing as adjuncts to printing presses where successive blank sheets of paper are lifted off a stack of papers by a vacuum device and passed through the press.

A problem occurs when the items to be singulated are of unequal size from one to the next. In that situation the design of a vacuum pad that works with all contemplated sizes of items is very difficult. If the pad is small enough not to extend off the edges of the smallest item it may be inadequate in the amount of vacuum to lift the largest item off the stack. Conversely if the vacuum pad is made large enough to lift even the largest item off a stack it may be so large as to lift off items beneath a small item in the stack.

SUMMARY OF INVENTION

In accordance with a preferred embodiment of the present invention a vacuum pad comprises a block of material having spaced apart orifices along one surface thereof each connected to a common plenum, means connected to the plenum for normally creating a reduced pressure relative to atmospheric pressure at said orifices and means for creating elevated pressure at selected ones of said orifices.

DETAILED DESCRIPTION OF THE PREFERRED EMBODIMENT

Figure 1:
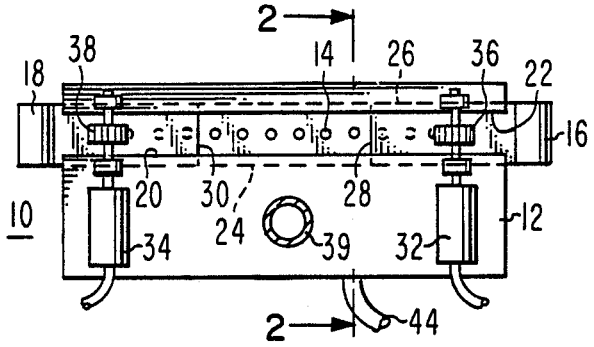
FIG. 1 is a plan view of an adjustable vacuum pad in accordance with a preferred embodiment of the present invention.

Referring first to FIG. 1, a plan view of a vacuum pad 10 constructed in accordance with a preferred embodiment of the present invention is illustrated. The pad comprises a rectangular block of material 12 containing a plurality of orifices such as 14 and other passageways illustrated in detail in other figures to be described hereinafter and a pair of coil springs 16 and 18 positioned at opposite ends of block 12 and extending toward one another along a slot defined by lines 20 and 22 and hidden lines 24 and 26 best illustrated in FIG. 2. A particularly useful type of coil spring is the Negator spring. The Negator spring is a brand name product which has the desirable property of constant force as various lengths of spring are uncoiled. The end of coil spring 16 is represented by line 28 while the end of coil spring 18 is represented by line 30. A pair of motors 32 and 34 are mounted at respective ends of bock 12. Toothed wheels 36 and 38 respectively are attached to the shafts of motors 32 and 34. The toothed wheels are in contact with coil springs 16 and 18 respectfully. The purpose of motors 30 and 32 respectively is to drive coil springs 16 and 18 respectively toward or away from one another to cover or uncover selected orifices such as 14 for purposes to be described hereinafter. As illustrated in FIG. 1 springs 16 and 18 are covering an equal number of orifices but that is not a requirement. One coil spring could be covering a relatively large number of orifices while the other could be covering a relatively small number or none. The cross-sectioned cylinder 39 attached to pad 10 is the means whereby pad 10 is attached to a munipulating arm of a robot to be described hereinafter.

Figure 2:
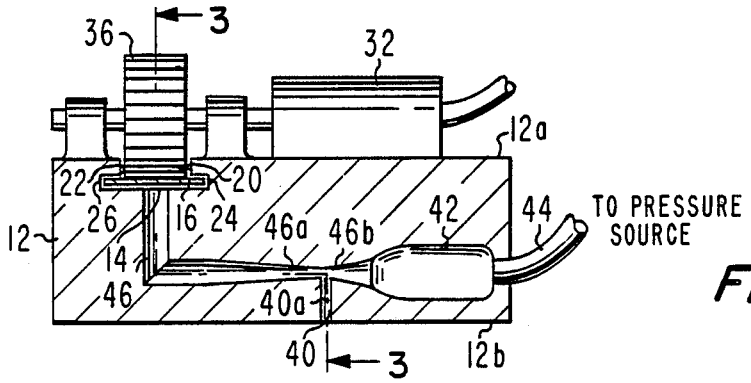
FIG. 2 is a elevation cross section view of the vacuum pad illustrated along lines 2—2 of FIG. 1.

Referring next to FIG. 2 which is a cross section along lines 2—2 of FIG. 1 the particular cross section area being chosen so as to reveal the shape of the various orifices and channels in block 12. In FIG. 2 a channel of varying cross-sectional area 46 is shown to extend from an orifice 14 in one wall of the slot defined by lines 22, 26, 24 and 20, through constricted regions 46*a* and 46*b* to a general plenum 42 to which each of the similar channels 46 have equal access. Channel 40*a* extends from the junction of the constricted regions 46*a* and 46*b* to orifice 40 on the lower surface 12*b* of block 12. It will be understood that typically there will be a plurality of inline orifices 14, spaced approximately 13 mm apart across the desired width of block 12, which may be of any length useful for a specific application.

Plenum 42 is connected to a suitable conduit 44 which leads to a source of pressurized air (not shown). Constricted regions 46*a* and 46*b* together comprise a structure which can operate as venturi when orifice 14 is open, allowing air to flow from plenum 42. The air flow will be accelerated in regions 46*a* and 46*b*, creating a partial vaccum condition which is communicated to orifice 40 by channel 40*a*. With regard to FIG. 2 it will be understood that, although block 12 appears to be illustrated as a single block of material, in reality it will comprise several pieces of material to enable manufacture of the various orifices and passageways illustrated in FIG. 2.

Operation of the structure illustrated in FIG. 2 is as follows. A source (not shown) supplies a positive air pressure to plenum 42. Depending on whether a coil spring 16 or 18 covers a particular orifice 14 there will either be a vacuum (reduced pressure relative to atmospheric pressure) or positive pressure relative to atmospheric pressure at the associated orifices 40. That is, if the coil spring, 16, for example, is not covering a particular orifice 14 then the positive air pressure escapes through orifice 14 and the associated venturi 46*a* and 46*b* causes a vacuum to appear at the associated orifice 40. Conversely if coil spring, 16, for example, covers a particular orifice 14, the air pressure is directed through associated orifice 40 creating a pressure at that particular orifice at surface 12*b* of block 12.

Figure 3:
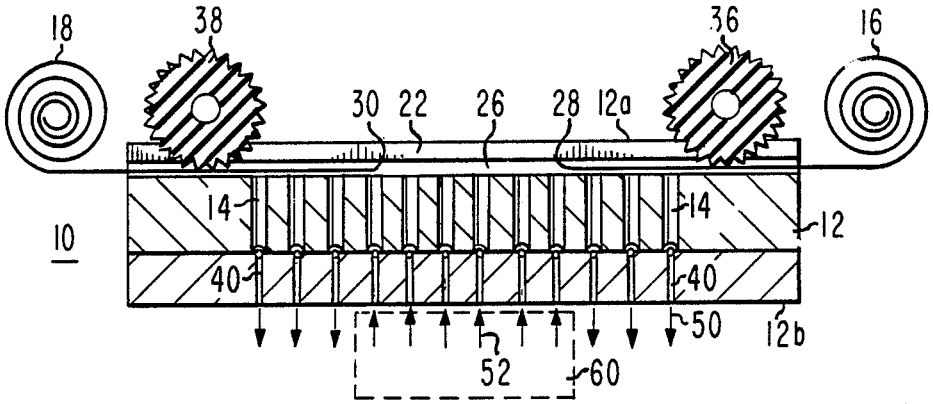
FIG. 3 is a elevation cross sectional view of the vacuum pad along lines 3—3 of FIG. 2.

FIG. 3 is a cross sectional view along lines 3—3 of FIG. 2 and is thus an elevational cross section view. In FIG. 3 the downward pointing arrows such as 50 are associated with those orifices 40 through which exit air at elevated pressure. This is true because the associated coil spring 16 or 18 is covering the associated orifice 14.

Conversely upward pointing arrows such as 52 are associated with orifices 40 where an associated orifice 14 is not covered by coil spring 28 or 30 and thus air is free to exit through that particular orifice. Dashed line 60 illustrates an item which is attracted by means of vacuum to vacuum pad 10 and particularly to the underside **12*b* of block 12. Not only are items not attracted to those orifices 40 where coil springs are covering the associated orifices 14 but to the contrary air is blown out of those orifices forcing items away from underside 12*b* of block 12**.

Figure 4:
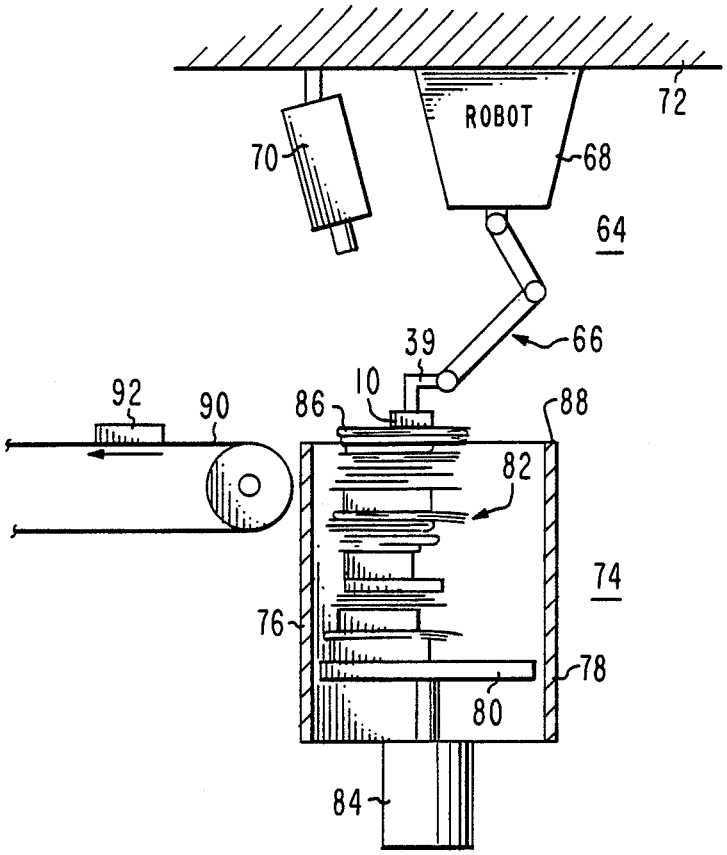
FIG. 4 is a mail singulation system utilizing the vacuum pad of the present invention.

In FIG. 4 to which attention is now directed vacuum pad 10 is part of a mail singulation station. The mail singulation system includes a robot 64 of conventional design which in turn includes an articulated arm 66 at the end of which is located vacuum pad 10. The robot base 68 and a camera 70 are mounted from a suspended platform 72 over a mail bin 74 illustrated cut away. Mail bin 74 may take the form of a rectangular container comprising side walls 76 and 78 (the end walls are not illustrated for drawing clarity.) and a raisable floor 80. Mail pieces 82 of various sizes, shapes, and weight are stacked (by means not shown) into bin 74. A raising mechanism 84 attached to bin floor 80 causes the mail pieces 82 to be raised such that the top mail piece 86 is always generally level with the top surface 88 of bin 74. A take away conveyor 90 is positioned relative to bin 74 such that mail removed from bin 74 (mail piece 92 being exemplary) can be easily moved from bin 74 to the conveyor to be taken away thereby. The purpose of camera 70 is to scan each mail piece such as 86 to determine its dimension along the length dimension of vacuum pad 10.

Figure 5:
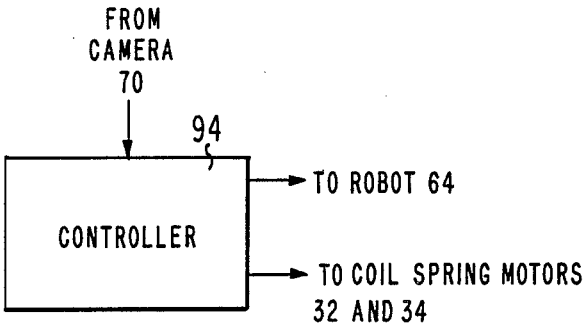
FIG. 5 illustrates the electrical interconnection among the various components of the mail singulation system of FIG. 4.

FIG. 5, to which attention is now directed, illustrates the electrical interconnection among the various parts. A controller 94 receives signals from camera 70, the signals being indicative of the dimension of each top mail piece such as 86 in FIG. 4 and its location laterally of pad 10. The received signals are translated as necessary and transmitted to coil spring motors 32 and 34 to position coil springs 16 and 18 respectively such that the space between the ends 28 and 30 (FIG. 1) thereof is of approximately the same dimension as the particular mail piece 86 which is at the top of the stack of mail 82 (FIG. 4). Furthermore the specific orifices 40 which are at a vacuum correspond to the lateral location of mail piece 86 along pad 10 (left-to-right in FIG. 3).

Controller 94 is also coupled to robot 64 to provide signals thereto to direct motion of vacuum pad 10 to mail piece 86 once the proper area of vacuum pad 10 is created. Then vacuum pad is moved by robot arm 66 to pick up mail piece 86 and transport it to take away conveyor 90. It will be understood that, although the particular signals transmitted between controller 94 and robot 64 are complex, these are well known and will not be described in detail here since those particular instructions are not part of the present invention.

Operation of the mail singulation system including the operation of the vacuum pad 10 is as follows. Raising mechanism 84 (FIG. 4) moves floor 80 of mail bin 74 up such that the top mail piece 86 is level with top surface 88 of mail bin 74. This may be accomplished by means (not shown) for determining when the top piece of mail rises just above top surface of lip 88. Then camera 70 determines the width of that mail piece 86 and sends a signal corresponding thereto to controller 94. Controller 94 sends signals to one or both of motors 32 and 34 (FIG. 1) to move coil springs 16 and 18 respectively to uncover such orifices 40 (FIG. 3) in number as to correspond with the width of mail piece 86. As mentioned previously in connection with the operation of vacuum pad 10, when a orifice 14 (FIG. 2) is not sealed off by coil spring, air coming from a pressure source (not illustrated) creates a venturi effect in region 46 thereby causing a vacuum at that orifice 40 associated with a particular orifice 14 which is not covered by a coil spring.

Where a particular orifice 14 is covered by a coil spring, air pressure in plenum 42 is forced out of that associated orifice 40 thereby creating not only not a vacuum but positive pressure. Once springs 28 and 30 are positioned to provide vacuum at orifices 40 corresponding in number to the size of mail piece 86, a signal is sent to robot 64 causing it to direct vacuum pad 10 to the mail piece 86 to lift that mail piece and to move it to conveyor 90 where it is carried away. Then floor 80 is again raised so the next mail piece is in line with upper surface 88 of the mail bin and the process above-described repeats.

With regard to vacuum pad 10 it should be understood that block 12 does not have to be in any particular shape but rather shaped to the nature of items to be picked up thereby. Thus, for example, orifices 40 could be in two or more rows. As viewed in FIG. 3 surface **12*b* could be concave or convexed in shape. Thus the term block is used with as in block 12** can be whatever shape is appropriate to the task to be undertaken.

What is claimed is:

1. A vacuum pad comprising in combination a block of material having a plurality of spaced apart orifices along one surface thereof each of said orifices being connected to a common plenum and having a connecting passageway to an orifice to the atmosphere;

means connected to said plenum for normally creating a reduced pressure relative to atmospheric pressure at said orifice; and means for covering said orifice to the atmosphere for creating elevated pressure at selected ones of said orifices.

2. The combination as set forth in claim 1 wherein said means for normally creating said reduced pressure comprises a venturi in said passageway to said atmosphere in the vicinity of each of said spaced apart orifices.

3. The combination as set forth in claim 1 wherein said orifices to the atmosphere are in line and N in number and wherein said means for covering each of said orifices to the atmosphere comprises first and second means, said first means covering a number $Y=0$ to $N-1$ of orifices starting from one end of said line, said second means covering a number $X=0$ to $(N-1-Y)$ of said orifices starting from the other end of said line.

4. An item singulation system for singulating items of unlike size from a stack of items, comprises in combination:

a vacuum pad comprising a plurality of orifices on a surface thereof which is oriented toward and generally parallel to said stack of items;

means for determining the size and position laterally of the item of said stack of items nearest said pad;

means for creating at said orifices a reduced pressure relative to atmospheric pressure of those orifices of said plurality which correspond to the size and position of said nearest item and for creating an elevated pressure relative to atmospheric pressure at the others of said orifices; and means for moving said vacuum pad to a position of contact with said nearest item and then to move said vacuum pad and nearest item away from said stack of items.

5. The combination as set forth in claim 4 wherein for each of said spaced apart orifices there is a connecting passageway to an orifice to the atmosphere and wherein said means for creating elevated pressure comprises means for covering said orifice to said atmosphere for creating elevated pressure.

6. The combination as set forth in claim 5 wherein said means for normally creating said reduced pressure comprises a venturi in said passageway to said atmosphere in the vicinity of each of said spaced apart orifices.

7. The combination as set forth in claim 5 wherein said orifices to the atmosphere are in line and N in number and wherein said means for covering each of said orifices to the atmosphere comprises first and second means, said first means covering a number $Y=0$ to $N-1$ of said orifices starting from one end of said line, said second means covering a number $X=0$ to $(N-1-Y)$ of said orifices starting from the other end of said line.

* * * * *